United States Patent [19]
Bergsma et al.
[11] 4,318,223
[45] Mar. 9, 1982

[54] SHAVING APPARATUS

[75] Inventors: Wijtse Bergsma; Pieter Riemersma, both of Drachten, Netherlands

[73] Assignee: U.S. Philips Corporation, New York, N.Y.

[21] Appl. No.: 192,115

[22] Filed: Sep. 29, 1980

[30] Foreign Application Priority Data

Oct. 30, 1979 [NL] Netherlands ..... 7907946

[51] Int. Cl.³ ..... B26B 19/14
[52] U.S. Cl. ..... 30/43.6
[58] Field of Search ..... 30/43.6, 43.5

[56] References Cited

U.S. PATENT DOCUMENTS

| | | | |
|---|---|---|---|
| 3,233,323 | 2/1966 | Driessen | 30/43.5 X |
| 4,001,932 | 1/1977 | Herrick | 30/43.5 |
| 4,087,909 | 5/1978 | Naemura | 30/43.6 |
| 4,168,570 | 9/1979 | Bakker et al. | 30/43.6 |

*Primary Examiner*—Jimmy C. Peters
*Attorney, Agent, or Firm*—Thomas A. Briody; William J. Streeter; Rolf E. Schneider

[57] ABSTRACT

A shaving apparatus comprises a housing and a shaving head provided with at least one shaving unit having a stationary cutting member and a cooperating cutting member drivable by means of a motor and a coupling spindle. At a location near the rim of each stationary cutting member the housing is provided with an axially adjustable pin, one end of which engages such rim. The stationary cutting member is engaged and supported by a resilient element at another location near its rim, the stationary cutting member being pivotable about the axially adjustable pin against the action of the resilient element. The other end of each axially adjustable pin engages an inclined contact face of a flexible endless band. By means of an actuating arm and an actuating knob on the housing wall, this flexible endless band is movable in a direction substantially transverse of the axial direction of each pin.

5 Claims, 11 Drawing Figures

SHAVING APPARATUS

The invention relates to a shaving apparatus comprising a housing, a shaving head with at least one shaving unit, which shaving unit comprises a stationary cutting member and a cutting member which is drivable by means of a motor and a coupling spindle, a retaining member for retaining the components of the shaving unit in the shaving head, the housing being provided with an adjustable stop at a location near the rim of the stationary cutting member, the stationary cutting member being supported by a resilient element at another location near the rim, and the stationary cutting member being pivotable about the stop against the action of the resilient element.

Such a shaving apparatus is for example known from U.S. Pat. No. 4,168,570.

It is the object of the invention to provide a construction which leads to a small number of components which are cheap to manufacture and simple to assemble, so that the apparatus is suitable for mass-manufacture.

According to the invention the shaving apparatus is characterized in that the stop takes the form of an axially adjustable pin, whose end which is remote from the stationary cutting member engages with an inclined contact face of a flexible band, which flexible band by means of an actuating arm and an actuating knob on the housing wall is movable in a direction substantially transverse of the axial direction of the pin.

A special embodiment is characterized in that a separate first retaining member for the stationary cutting member, a separate second retaining member for the drivable cutting member and the resilient element in the form of a leaf spring are combined to form a detachable component.

Another special embodiment is characterized in that a fixing member is rotatably secured to the detachable component, which fixing member together with a corresponding pin on the shaving head constitute fixing means for attaching the detachable component to the shaving head.

A preferred embodiment is characterized in that the first retaining member is constituted by a plate-shaped body with a number of openings corresponding to the number of shaving units, the second retaining member takes the form of a moulded plastics product with openings for the coupling spindles, and the resilient elements are integral with a substantially polygonal frame of a resilient sheet material and have been bent out of the plane of said frame, the frame being clamped between the first and the second retaining member and the fixing member being rotatably secured to the second retaining member.

Another preferred embodiment is characterized in that the fixing member is formed with a through-going opening of triangular shape and the pin has a correspondingly shaped end, whilst by rotation the retaining member can be latched behind hook-shaped portions on the end of the pin.

The invention will now be explained by describing an embodiment which is shown in the Figures.

FIG. 1 is a perspective view of a shaving apparatus having a shaving head with three shaving units.

FIGS. 2 and 3 schematically represent a side view of the shaving head of the apparatus of FIG. 1 with different positions of the shaving units.

Figure 1:
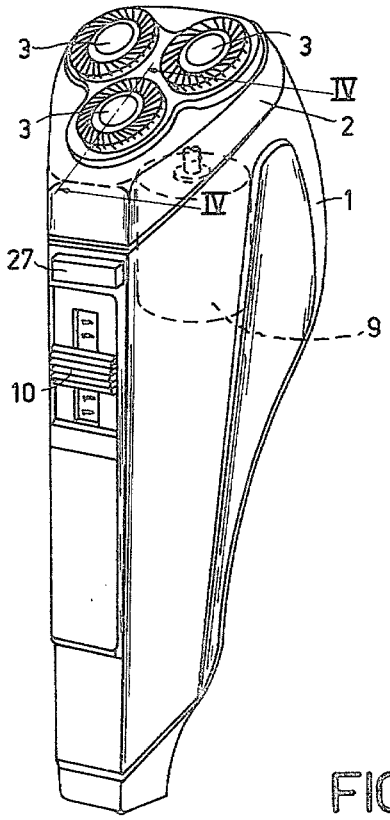

The shaving apparatus shown in the Figures comprises a housing 1 with a shaving head 2 with three shaving units 3. Each shaving unit 3 is situated in an opening 4 in the shaving head 2 and comprises a stationary shaving member 5 with hair-entry apertures 6 and a rotatable shaving member 7. The shaving member 7 is coupled to the electric motor 9 by means of the coupling spindle 8 (FIGS. 1 through 7).

Figure 2:
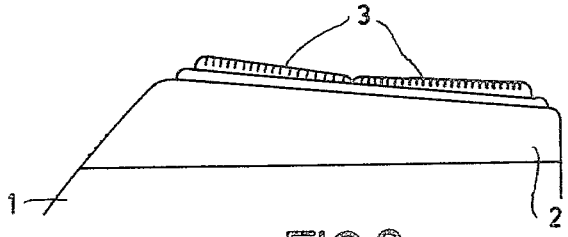
Figure 3:
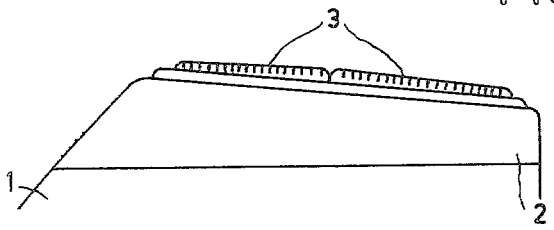
Figure 4:
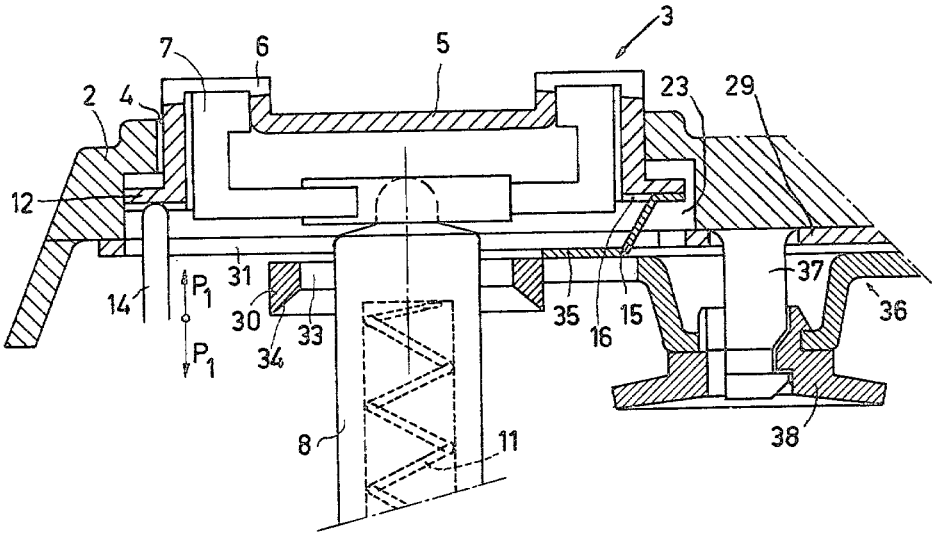
FIG. 4 is a cross-sectional view, taken on the line IV—IV of FIG. 1, of a detail of the shaving head.

The shaving apparatus is provided with an adjusting mechanism which can be actuated by means of a knob 10 on the wall of the housing 1. By means of this adjusting mechanism, to be described hereinafter, the shaving units 3 can be adjusted to different positions relative to the shaving head 2. FIGS. 2 and 3 show two such positions, the apparatus being adapted to shave a convex skin surface in the position of FIG. 2 and the apparatus being adapted to shave a concave skin surface in the position of FIG. 3. Moreover, it has been found that for a position of the shaving units as shown in FIG. 3 the irritating sensation which may occur after shaving a sensitive skin is substantially reduced or does not occur at all.

Figure 5:
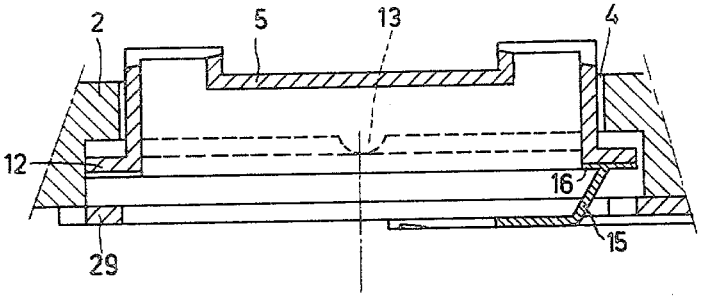
FIG. 5 is a similar cross-sectional view as in FIG. 4, the drivable cutting member and the coupling spindle being omitted.
Figure 6:
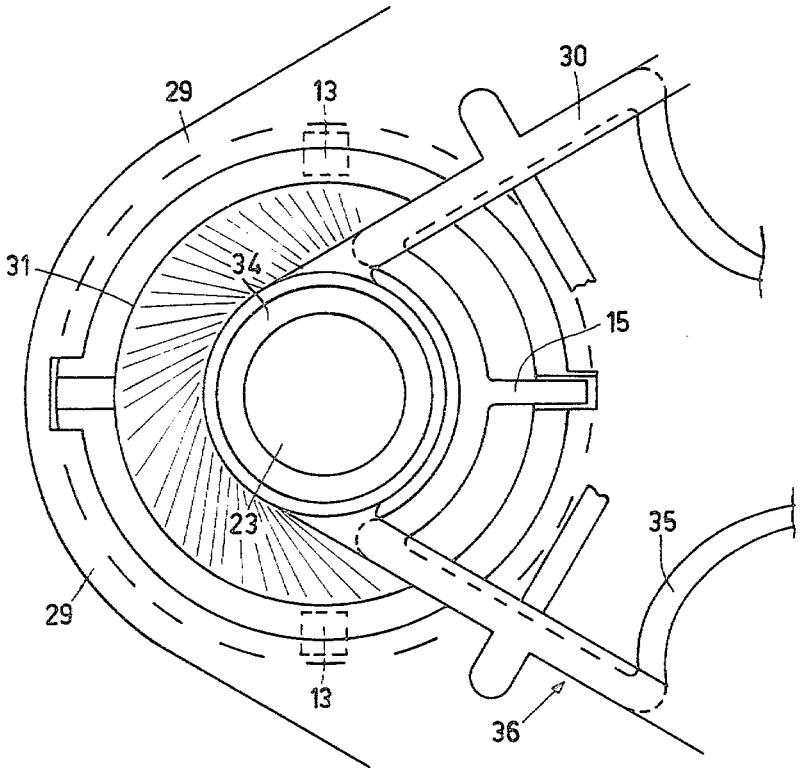
FIG. 6 is a bottom view of the detail of FIG. 4, without fixing means.

The coupling spindle 8 (FIG. 4) accommodates a spring 11, so that the coupling spindle 8 exerts a force on the shaving unit 3. As a result of this the flange 12 of the stationary cutting member 5 is urged against two diametrically opposed cams 13 at the edge of the opening 4 (FIG. 5). Moreover, the flange 12 is locally supported by an adjustable stop 14 and a resilient element 15.

One end of the resilient element 15 engages with the groove 16 in the flange 12, which prevents the stationary shaving member 5 from rotating with the rotatable shaving member 7. The resilient element 15 exerts a force on the stationary shaving member, so that the facing portion of the flange 12 is urged against the stop 14.

The stops 14 for the three shaving units are simultaneously adjustable in the directions $P_1$ by means of an adjusting mechanism. The stationary shaving members 5 then pivot about the cams 13 (FIGS. 5 and 6), so that these shaving members can assume different positions relative to the shaving head 2. The drivable shaving members 7 are pivotably journalled on the coupling spindle 8, said coupling spindles themselves also being pivotable, so that the drivable shaving members 7 can follow the pivotal movements of the stationary shaving members 5.

Figure 8:
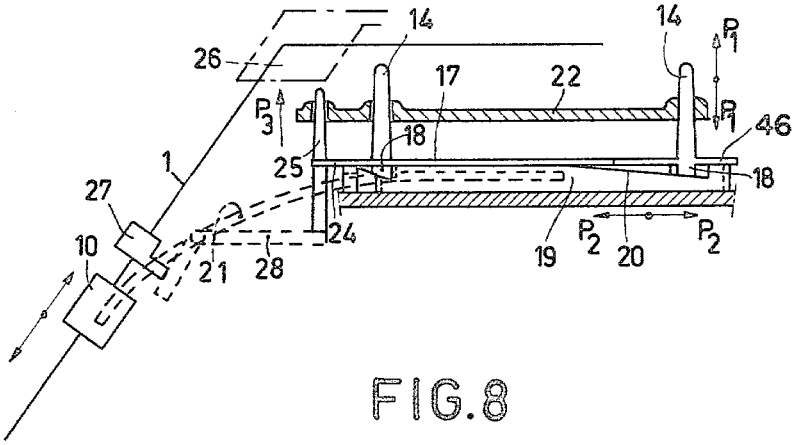
FIG. 8 is a side view of the adjusting mechanism for the shaving units of the apparatus of the preceding Figures, the housing being represented schematically and other components being omitted.
Figure 9:
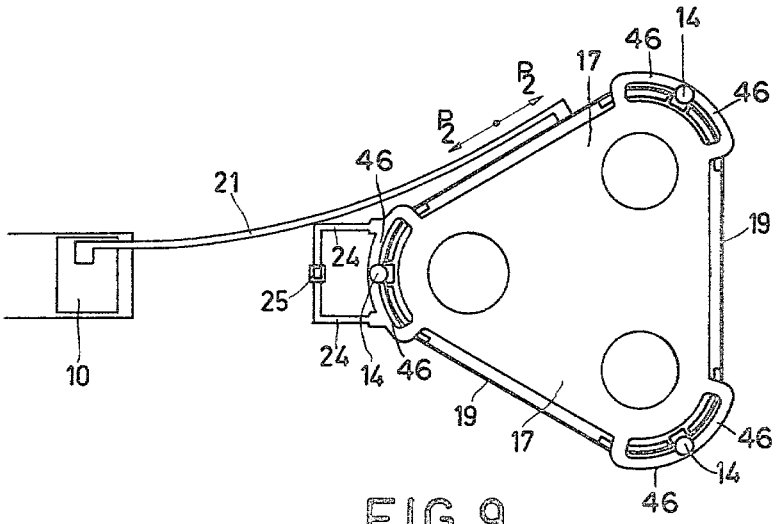
FIG. 9 is a bottom view of the adjusting mechanism of FIG. 8.

By means of elastic arms 46 (FIGS. 8 and 9) the stops 14 are secured to a common plate 17 and project from underneath the plate with a cam 18 which is remote from the stationary shaving member. The adjusting member comprises a flexible endless band 19. This band 19 has inclined supporting faces 20 with which the cams 18 engage. By means of a flexible strip 21 the band 19 is connected to the knob 10 on the wall of the housing 1. By adjusting the knob 10 the band 19 is moved in the directions $P_2$ via the strip 21, so that the inclined supporting faces 20 slide along the cams 18. As a result of this the stops 14 are moved in the directions $P_1$.

Via openings in a partition 22 (FIG. 7) in the housing 1 the stops 14 extend up to the location of the stationary shaving members 5. The partition 22 forms the bottom of a receptacle 23 for shaving particles underneath the shaving units 3.

Figure 7:
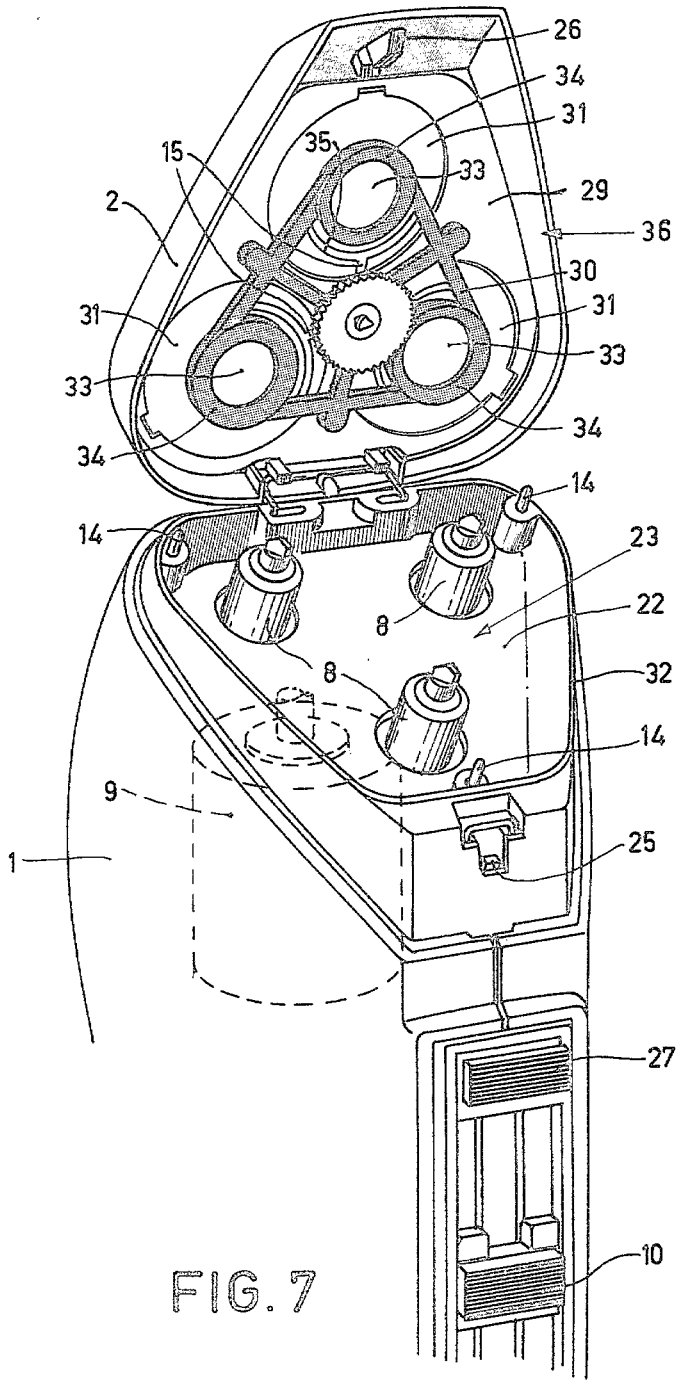
FIG. 7 is a perspective view of the shaving apparatus of FIG. 1 with the shaving head swung open.

Furthermore a pin 25 (FIGS. 8 and 9) is secured to the common plate 17 by means of elastic arms 24. In the closed operating position of the shaving head 2 relative to the housing the pin 25 engages with a cam 26 of the shaving head 2. In this position the shaving head 2 is retained by a snapped connection, known per se. By depressing the push-button 27 in the wall of the housing 1 the pin 25 can be moved in the direction $P_3$ via the lever 28, so that the snapped connection is released and the shaving head opens (FIG. 7).

The shaving head 2 is generally pivotably connected to the housing 1. In the open position of the shaving head 2 the stationary shaving members and the drivable shaving members are retained in the shaving head by a first retaining member 29 and a second retaining member 30 respectively. The first retaining member 29, which also constitutes a stop which limits the movements of the shaving units, is a plate-shaped member with three openings 31.

In the closed position of the shaving head 2 the first retaining member 29 also rests on the rim 32 of the hair chamber, thus providing a satisfactory sealing between the housing 1 and the shaving head 2. Moreover, any forces exerted on the first retaining member 29 by the stationary shaving members are directly transmitted to the housing and not via separate fixing means, if any, by which the retaining member is fixed to the shaving head. The second retaining member 30 takes the form of a moulded plastics product with three openings for the coupling spindles 8. The openings 33 have funnel-shaped wall portions 34, which facilitates engagement of the coupling spindles 8 with the openings 33 when the shaving head 2 is closed. The resilient elements 15 are integral with a substantially polygonal frame 35 of a resilient sheet material, the resilient elements 15 being bent out of the plane of said frame 35. The second retaining member 30 is for example secured to the first retaining member 29 by thermal deformation of connecting studs, the frame 35 being clamped between the members 29 and 30.

Figure 10:
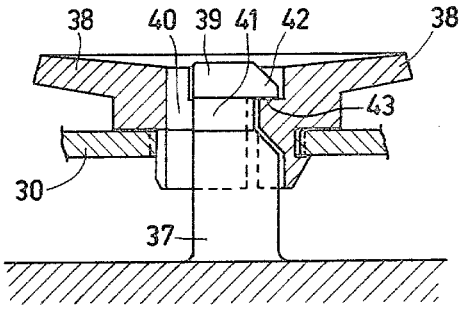
FIG. 10 shows a detail of a cross-sectional view over the fixing means of the retaining member for the shaving units in the shaving head.
Figure 11:
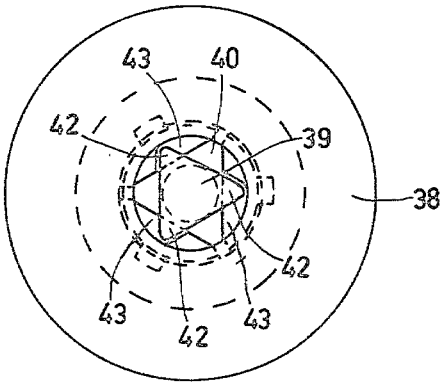
FIG. 11 is a bottom view of the fixing means of FIG. 10.

In this way different materials may be selected for the retaining members and the resilient elements, which owing to their specific properties are particularly suitable for the relevant element. Subsequently, said elements are assembled to a single detachable component 36. This component 36 may for example be secured to the shaving head 2 by means of a pin 37 on the shaving head and a fixing member 38 (FIGS. 10 and 11). The pin has an end 39 of triangular cross-section. The fixing member 38 is rotatably mounted on the second retaining member 30 and formed with a corresponding triangular opening 40. If the opening 40 is in line with the end 39 the component 36 can be slid over the pin 37 until the opening 40 is disposed at the location of the cylindrical neck 41 of the pin 37. The fixing member 38 can now be rotated 60°, the hook-shaped portions 42 of the triangular end 39 of the pin 37 engaging behind wall portions 43 of the fixing member, thereby retaining this member.

What is claimed is:

1. A shaving apparatus comprising a housing, a shaving head associated with said housing and provided with at least one shaving unit having a stationary cutting member and a cooperating cutting member drivable by means of a motor and a coupling spindle, an element for retaining the cutting members of each shaving unit in the shaving head, an axially adjustable pin positioned in the housing at a location near the rim of the stationary cutting member of each shaving unit, one end of the adjustable pin engaging said rim, a resilient element engaging the rim of and supporting said stationary cutting member at another location near said rim, said stationary cutting member being pivotable about said adjustable pin against the action of said resilient element, a flexible endless band having an inclined contact face associated with each shaving unit, the other end of each adjustable pin engaging the corresponding inclined contact face of said flexible endless band, an actuating knob on the housing wall, and an actuating arm connecting the flexible endless band to the actuating knob, whereby, upon actuation of said actuating knob, the flexible endless band is movable in a direction substantially transverse of the axial direction of each adjustable pin.

2. A shaving apparatus as claimed in claim 1, in which the retaining element includes a separate first retaining member for the stationary cutting member of each shaving unit and a separate second retaining member for the drivable cutting member of each shaving unit, the resilient element of each shaving unit being formed as a leaf spring, said retaining members and said leaf springs being combined to form a detachable component.

3. A shaving apparatus as claimed in claim 2, which includes a fixing member rotatably secured to the detachable component, and a corresponding pin projecting from the shaving head and engageable by said fixing member for attaching the detachable component to the shaving head.

4. A shaving apparatus as claimed in claim 3, in which the first retaining member is constituted by a plate-shaped body having a number of openings corresponding to the number of shaving units, the second retaining member is formed as a moulded plastics element having openings for the respective coupling spindles, and the respective resilient elements are integral with a substantially polygonal frame of a resilient sheet material and have been bent out of the plane of said frame, the frame being clamped between the first retaining member and the second retaining member and the fixing member being rotatably secured to the second retaining member.

5. A shaving apparatus as claimed in claim 3 or 4, in which the fixing member is formed with an opening of triangular shape, and the projecting pin has a correspondingly shaped end provided with hook-shaped portions, whereby, upon rotation of said fixing member, the second retaining member is latched behind said hook-shaped portions.

* * * * *